US009974402B2

(12) United States Patent
Booska

(10) Patent No.: US 9,974,402 B2
(45) **Date of Patent: *May 22, 2018**

(54) THERMAL RECEPTACLE WITH PHASE CHANGE MATERIAL

(71) Applicant: Raymond Booska, Melbourne, FL (US)

(72) Inventor: Raymond Booska, Melbourne, FL (US)

( * ) Notice: Subject to any disclaimer, the term of this patent is extended or adjusted under 35 U.S.C. 154(b) by 119 days.

This patent is subject to a terminal disclaimer.

(21) Appl. No.: 14/931,418

(22) Filed: Nov. 3, 2015

(65) Prior Publication Data

US 2016/0051070 A1 Feb. 25, 2016

Related U.S. Application Data

(63) Continuation of application No. 13/835,446, filed on Mar. 15, 2013, now Pat. No. 9,181,015.

(51) Int. Cl.

| | |
|---|---|
| ***A47G 19/22*** | (2006.01) |
| ***B65D 81/38*** | (2006.01) |
| ***B65D 81/34*** | (2006.01) |
| ***F25D 3/08*** | (2006.01) |

(52) U.S. Cl.

CPC ..... *A47G 19/2288* (2013.01); *A47G 19/2266* (2013.01); *B65D 81/3484* (2013.01); *B65D 81/3869* (2013.01); *F25D 3/08* (2013.01); *F25D 2331/805* (2013.01)

(58) Field of Classification Search

CPC ..... B65D 81/38; B65D 81/3869; B65D 1/40; B65D 23/00; B65D 23/10; B65D 81/3886; B65D 39/00; B65D 81/3453; B65D 81/3484; A47G 19/2288; A47G 19/2266; F25D 3/08; F25D 2331/805

USPC ..... 62/457.1, 457.2, 457.3, 530; 220/603, 220/592.17

See application file for complete search history.

(56) References Cited

U.S. PATENT DOCUMENTS

| | | | |
|---|---|---|---|
| 1,182,042 | A | 5/1916 | Rubin |
| 1,679,621 | A | 8/1928 | Myers |
| 1,721,311 | A | 7/1929 | Muenchen |
| 2,761,580 | A | 9/1956 | Tamboles |
| 2,808,167 | A | 10/1957 | Polazzolo |
| 2,828,043 | A | 3/1958 | Hosford, Jr. |
| 2,863,037 | A | 12/1958 | Johnstone |
| 2,876,634 | A | 3/1959 | Zimmerman et al. |
| 3,096,897 | A | 7/1963 | Hansen |
| 3,205,677 | A | 9/1965 | Stoner |
| 3,302,428 | A | 2/1967 | Stoner et al. |
| 3,360,957 | A | 1/1968 | Paquin |
| 3,397,867 | A | 8/1968 | Van'T Hoff |
| 3,463,140 | A | 8/1969 | Rollor, Jr. |
| 3,521,788 | A | 7/1970 | Kandel et al. |
| 3,603,106 | A | 9/1971 | Ryan et al. |
| 3,725,645 | A | 4/1973 | Shevlin |
| 3,726,106 | A | 4/1973 | Jaeger |
| 3,766,975 | A | 10/1973 | Todd |
| 3,807,194 | A | 4/1974 | Bond |

(Continued)

*Primary Examiner* — Mohammad M Ali
(74) *Attorney, Agent, or Firm* — Dinsmore & Shohl LLP

(57) ABSTRACT

A liquid receptacle has an inner vessel for holding a liquid, an insulated outer shell spaced from the inner vessel, and a chamber defined between the inner vessel and the outer shell. A phase change material is disposed in the chamber for absorbing thermal energy from the liquid and then releasing the thermal energy back to the liquid to maintain the temperature of the liquid.

14 Claims, 8 Drawing Sheets

(56) References Cited

U.S. PATENT DOCUMENTS

| | | | |
|---|---|---|---|
| 3,830,148 | A | 8/1974 | Shevlin |
| 3,890,484 | A | 6/1975 | Kamins et al. |
| 3,910,441 | A | 10/1975 | Bramming |
| 3,961,720 | A | 6/1976 | Potter, Jr. |
| 3,995,445 | A | 12/1976 | Huskins |
| 4,184,601 | A | 1/1980 | Stewart et al. |
| 4,270,475 | A | 6/1981 | Fletcher et al. |
| 4,304,106 | A | 12/1981 | Donnelly |
| 4,357,809 | A | 11/1982 | Held et al. |
| 4,402,195 | A | 9/1983 | Campbell |
| 4,523,083 | A | 6/1985 | Hamilton |
| 4,528,439 | A | 7/1985 | Marney, Jr. et al. |
| 4,746,028 | A | 5/1988 | Bagg |
| 4,765,393 | A | 8/1988 | Baxter |
| 4,782,670 | A | 11/1988 | Long et al. |
| 4,823,974 | A | 4/1989 | Crosser |
| 4,932,225 | A | 6/1990 | Bighouse |
| 4,980,539 | A | 12/1990 | Walton |
| 4,982,722 | A | 1/1991 | Wyatt |
| 4,983,798 | A | 1/1991 | Eckler et al. |
| 5,009,083 | A | 4/1991 | Spinos et al. |
| 5,052,369 | A | 10/1991 | Johnson |
| 5,076,463 | A | 12/1991 | McGraw |
| 5,090,213 | A | 2/1992 | Glassman |
| 5,125,391 | A | 6/1992 | Srivastava et al. |
| 5,254,380 | A | 10/1993 | Salyer |
| 5,269,368 | A | 12/1993 | Schneider et al. |
| 5,271,244 | A | 12/1993 | Staggs |
| 5,329,778 | A | 7/1994 | Padamsee |
| 5,406,808 | A | 4/1995 | Babb et al. |
| 5,508,494 | A | 4/1996 | Sarris et al. |
| 5,573,141 | A | 11/1996 | Chen |
| 5,611,328 | A | 3/1997 | McDermott |
| 5,653,362 | A | 8/1997 | Patel |
| 5,755,988 | A | 5/1998 | Lane et al. |
| 5,842,353 | A | 12/1998 | Kuo-Liang |
| 6,000,565 | A | 12/1999 | Ibeagwa |
| 6,109,518 | A | 8/2000 | Mueller et al. |
| 6,161,720 | A | 12/2000 | Castle |
| RE37,213 | E | 6/2001 | Staggs |
| 6,367,652 | B1 | 4/2002 | Toida et al. |
| 6,408,498 | B1 | 6/2002 | Fields et al. |
| 6,634,417 | B1 | 10/2003 | Kolowich |
| 6,968,888 | B2 | 11/2005 | Kolowich |
| 7,059,387 | B2 | 6/2006 | Kolowich |
| 7,934,537 | B2 | 5/2011 | Kolowich |
| 8,205,468 | B2 | 6/2012 | Hemminger et al. |
| 2002/0000306 | A1 | 1/2002 | Bradley |
| 2004/0083755 | A1* | 5/2004 | Kolowich ..... A47G 19/127 62/457.3 |
| 2006/0032605 | A1 | 2/2006 | Kolowich |
| 2007/0056923 | A1 | 3/2007 | Liu |
| 2007/0144703 | A1 | 6/2007 | Kolowich |
| 2009/0045194 | A1 | 2/2009 | Rhee |
| 2009/0283533 | A1* | 11/2009 | Hemminger ..... B65D 43/022 220/592.17 |
| 2010/0108693 | A1 | 5/2010 | Zhang et al. |
| 2011/0204065 | A1 | 8/2011 | Kolowich |
| 2012/0080456 | A1 | 4/2012 | Steininger |

* cited by examiner

THERMAL RECEPTACLE WITH PHASE CHANGE MATERIAL

CROSS REFERENCE TO RELATED APPLICATION

This application is a continuation of U.S. patent application Ser. No. 13/835,446, filed Mar. 15, 2013, the contents of which are incorporated herein in their entirety.

FIELD OF THE INVENTION

The present invention relates generally to liquid receptacles, containers, and accessories for such receptacles that rapidly cool a hot liquid to a warm range and then maintain the liquid in the warm range for an extended period.

BACKGROUND OF THE INVENTION

There have been a variety of attempts to provide liquid receptacles and containers designed to alter the temperature of liquids contained therein. For example, insulated mugs seek to prevent heat loss to the surrounding environment and therefore maintain a beverage's temperature. It is also known to provide a liquid receptacle with a phase change material in the wall of the receptacle. The phase change material regeneratively absorbs thermal energy from the liquid and then releases the thermal energy back to the liquid to maintain the temperature of the liquid. There remains a need for improvements in this field.

SUMMARY OF THE INVENTION

The present invention provides a number of improved thermal receptacles or accessories utilizing one or more phase change materials. According to one embodiment, a liquid receptacle is provided for rapidly lowering the temperature of a liquid contained therein to a warm range suitable for human contact and maintaining the liquid in the warm range for an extended period. The receptacle has a drinking lip at an uppermost end and a base at a lowermost end. The receptacle includes an inner vessel for holding a liquid, having an open upper end and a closed lower end with a side wall extending therebetween. A first intermediate wall has an upper end and a lower end, and surrounds the inner vessel. It is at least partially spaced from the inner vessel so as to define a first chamber therebetween. An insulated outer shell has an open upper end and a lower end. The insulated outer shell surrounds the first intermediate wall and is at least partially spaced therefrom so as to define a second chamber therebetween. A first phase change material is disposed in the first chamber for regeneratively absorbing thermal energy from the liquid and then releasing the thermal energy to the liquid to maintain the temperature of the liquid.

In some versions, a second phase change material is disposed within the second chamber. This phase change material has a phase change temperature different than the first phase change material. The phase change temperature of the second phase change material may be different than the phase change temperature of the first phase change material.

In some versions, the insulated outer shell includes a second intermediate wall surrounding the first intermediate wall and an outer wall surrounding the second intermediate wall. The outer wall is at least partially spaced from the second intermediate wall so as to define an insulation chamber therebetween. The insulation chamber has a partial vacuum or an insulating material disposed therein. In one approach, the outer wall and the second intermediate wall comprise an outer two wall cup having a closed lower end and an open upper end. The upper end of the outer wall and the upper end of the second intermediate wall are interconnected to define the open upper end of the outer two wall cup. The inner vessel and the first intermediate wall comprise an inner two wall cup having a closed lower end and an open upper end. The upper end of the inner vessel and the upper end of the first intermediate wall are interconnected to define the open upper end of the inner two wall cup. The inner two wall cup is received inside the outer two wall cup to form the liquid receptacle. The inner two wall cup may threadingly engage the outer two wall cup. Alternatively, a lip element may be provided that has an upper part defining the drinking lip of the liquid receptacle and a lower part receiving the upper ends of the inner two wall cup and outer two wall cup. The entire device may alternatively be made as a single unit using blow molding or some other plastic forming process.

In some versions, the inner vessel is formed of metal and the first intermediate wall is formed of thermally conductive plastic, such as a thermally conductive high density polyethylene.

In some versions, the first intermediate wall has a closed bottom spaced from the closed bottom of the inner vessel and the insulated outer shell has a closed bottom spaced from the closed bottom of the first intermediate wall. The inner vessel, first intermediate wall, and insulated outer shell are interconnected adjacent the upper ends of the vessel wall and shell.

Some versions further include a lip element having an upper part defining the drinking lip of the liquid receptacle and a lower part interconnected with the upper ends of the inner vessel, first intermediate wall, and insulated outer shell.

In some embodiments of the present invention, the inner vessel has an inner surface with a plurality of indentations or protrusions defined therein and an outer surface with a plurality of corresponding protrusions or indentations defined thereon such that the effective surface area of the inner and outer surfaces is increased, whereby the heat transfer through the wall of the inner vessel is increased. The wall thickness of the inner vessel may be substantially uniform, including the areas of the indentations and protrusions, or varying wall thicknesses may be utilized.

In some embodiments of the present invention, a metal heat transfer element is disposed in the chamber containing the phase change material, along with the phase change material. The metal heat transfer element may be aluminum wool, a folded fin heat sink, or a mesh of metal or other thermally conductive material.

The present invention also provides an accessory for use with an insulated cup for providing the benefits of a phase change material to the insulated cup. This phase change apparatus is designed to rapidly lower the temperature of a liquid contained in the insulated cup. The apparatus includes a generally tubular housing having an open upper end and an open lower end with a side wall extending therebetween. The side wall has an inner surface and an outer surface and a chamber defined in the side wall. A phase change material is disposed within the chamber for regeneratively absorbing thermal energy from a liquid and then releasing the thermal energy of the liquid to maintain the temperature of the liquid. The upper end of the generally tubular housing is configured to engage an upper end of an insulated cup such that the generally tubular housing extends down into the insulated cup inside the side walls of the insulated cup. A plurality of passages are defined between the inner surface and outer surface of the side wall of the generally tubular housing. The passages are defined near the upper end of the generally tubular housing such that liquid disposed between the outer surface of the generally tubular housing and the side wall of the insulated cup flows through some of the passages when the insulated cup is tilted for drinking. In some versions, the generally tubular housing is tapered such that the upper end has a width greater than a width of the lower end. In some versions, the upper end of the generally tubular housing has a lip element with an upper part defining a drinking lip and a lower part configured to receive an upper edge of the insulated cup.

In another embodiment of the present invention, a liquid receptacle has an inner vessel with an open upper end and a closed lower end with a side wall extending therebetween. The inner vessel has an inner surface and an outer surface. The inner vessel is formed of metal. An insulated outer shell has an open upper end and a closed lower end. The shell has an inner surface. The open upper ends of the inner vessel and the outer shell are interconnected by double rolling the upper end of the inner vessel with the upper end of the outer shell and crimping the double rolled upper ends to form a joined upper end. A chamber is defined between the inner surface of the outer shell and the outer surface of the inner vessel. A phase change material is disposed within the chamber for regeneratively absorbing thermal energy from the liquid and then releasing the thermal energy to the liquid to maintain the temperature of the liquid. In some versions, a lip element is provided having an upper part defining the drinking lip and a lower part receiving the joined upper end of the inner vessel and outer shell.

In some versions, the insulated outer shell comprises a first wall and a second wall each having an open upper end and a closed lower end. The first and second walls are joined at the open upper ends to form the outer shell. An insulation chamber is defined between the first and second walls and the chamber has a vacuum or an insulating material defined therein. In some versions, the first and second walls are formed of plastic. Alternatively, one of the walls may be formed of plastic.

In some versions, the inner vessel has an inner surface with a plurality of indentations defined therein and an outer surface with a plurality of corresponding protrusions defined thereon such that the effective surface area of the inner and outer surfaces is increased, whereby heat transfer through the inner vessel is increased. In further versions, a metal heat transfer element is disposed in the chamber and partially fills the chamber. The metal heat transfer element is selected from the group consisting of a body of aluminum wool, a folded fin heat sink, and a mesh of metal or other thermally conductive material.

DETAILED DESCRIPTION OF THE PREFERRED EMBODIMENTS

The present invention provides a number of improved thermal receptacles or accessories that utilize at least one phase change material for rapidly lowering the temperature of a hot liquid to a suitable drinking range and then to maintain the temperature of that liquid at a suitable range for an extended period. The various features and elements of the embodiments discussed herein may be used in any combination.

Figure 1:
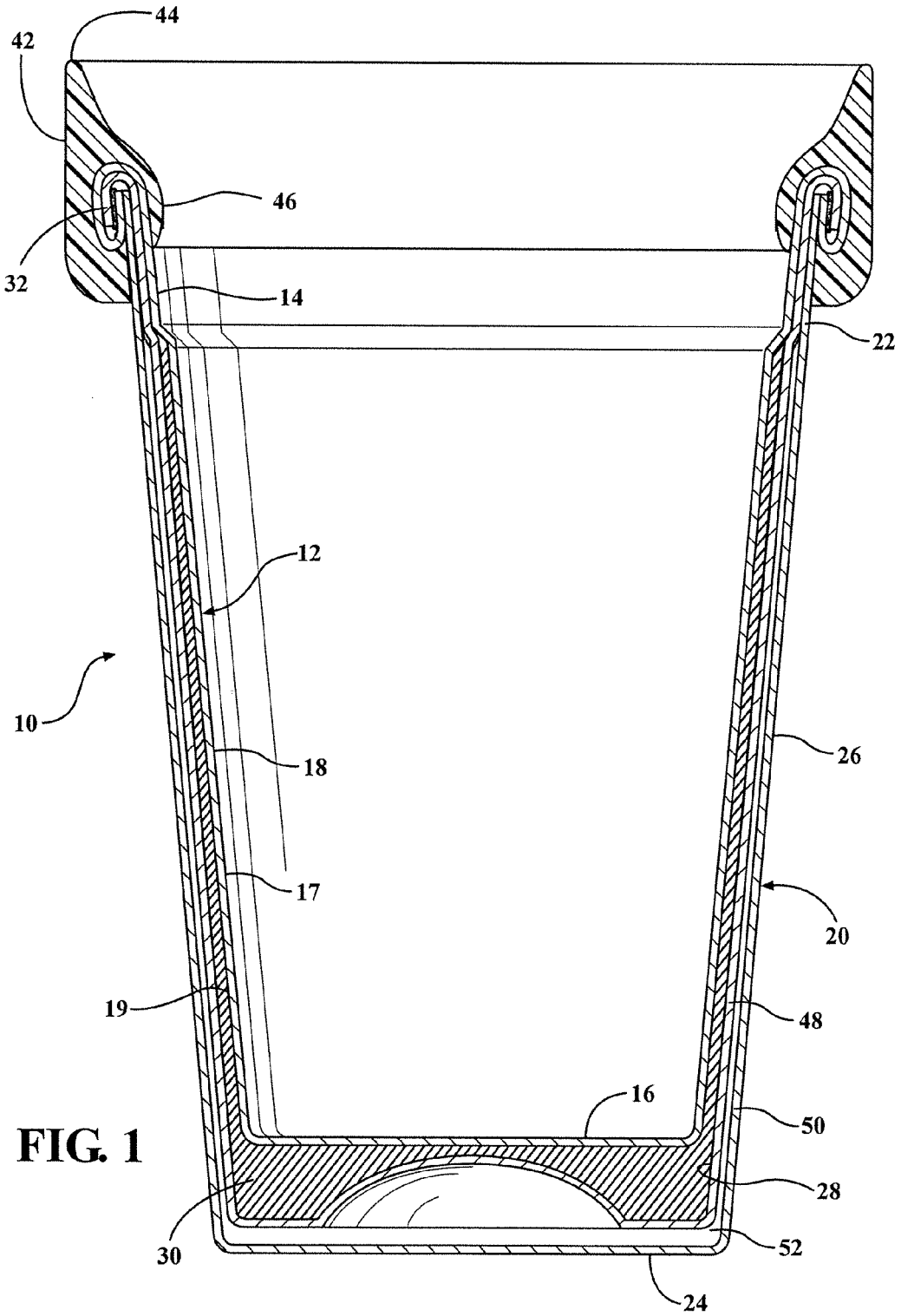
FIG. 1 is a cross-sectional view of a first embodiment of a liquid receptacle in accordance with the present invention.

FIG. 1 provides a cross-sectional view of a first embodiment of a liquid receptacle 10. The receptacle has an inner vessel 12 with an open upper end 14, a closed lower end 16, and a side wall 18 extending therebetween. In the illustrated embodiment, the side wall 18 tapers outwardly from the lower end to the upper end. The inner vessel 18 has an inner surface 17 and an opposed outer surface 19.

The receptacle 10 further has an insulated outer shell 20 with an open upper end 22 and a closed lower end 24. A side wall 26 may be said to extend between the closed lower end 24 and open upper end 22. Like the side wall 18, the side wall 26 tapers outwardly. The outer shell 20 has an inner surface 28 that is spaced from the outer surface 19 of the inner vessel so as to define a chamber 30 therebetween. In the illustrated embodiment, the chamber 30 extends between the respective side walls and between the respective closed lower ends of the inner vessel 12 and outer shell 20. A phase change material, also indicated at 30, fills the chamber. The open upper ends 14 and 22 of the inner vessel 12 and outer shell 20, respectively, are interconnected by a hermetic double seam created by double rolling the upper ends and compressing or crimping the double rolled ends so as to form a joined upper end 32.

Figure 2:
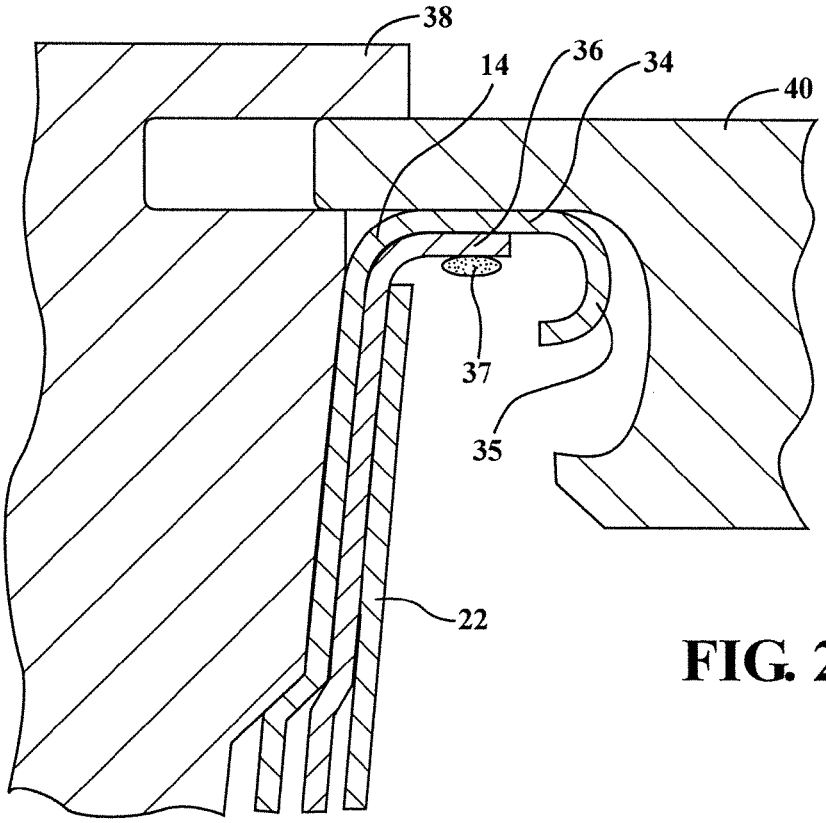
FIG. 2 is a cross-sectional view of a portion of an upper end of the receptacle prior to rolling and crimping.
Figure 3:
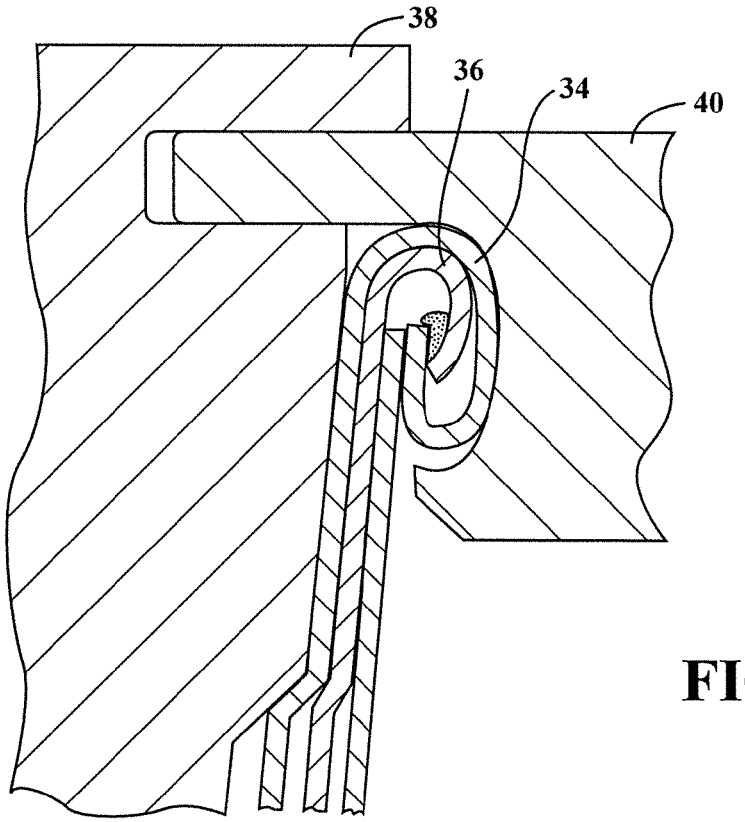
FIG. 3 is a cross-sectional view of the upper end of FIG. 2 during the crimping process.

Referring to FIGS. 2 and 3, this double seaming process is illustrated. In FIG. 2, the open upper end 14 of the inner vessel is shown having an outwardly extending flange 34.

The flange 34 has a curled portion 35 that extends downwardly and inwardly. The curled portion 35 may be created prior to the double seaming process or as part of the process. The open upper end 22 of the outer shell also has an outwardly extending flange 36. This flange 36 is shorter than and positioned just below the flange 34. The flange 36 is flat and stops short of the curled portion 35. A sealant may be applied as part of the double seaming process. A portion of sealant is shown at 37 on the underside of the flange 36.

A chuck 38 engages the inside of the upper end 14 of the inner vessel and a seam roller 40 moves in and engages the flanges 34 and 36. As the seam roller 40 moves inwardly to the position shown in FIG. 3, the flanges 34 and 36 are double rolled. That is, the flange 34 extends around the outside of the flange 36 as well as back up under it so that there are two "rolls" in the flange 34. The flange 36 is captured between two layers of the flange 34 and a portion of the flange 34 is captured between the flange 36 and the upper end 2 of the outer shell. Following the step shown in FIG. 3, the seam roller 40 may be moved further inwardly so as to compress or crimp the double rolled flanges or a separate crimping step and tool may be used. The finished hermetic double seam is shown at 32 in FIG. 1. As known to those of skill in the art, this illustrative process is similar to the process used to roll and seal the upper ends of metal cans.

Referring again to FIG. 1, some embodiments of the present invention may further include a lip element 42 that interconnects with the double seamed upper end. The lip element is illustrated as having an upper part 44 that defines a drinking lip and a lower part 46 that receives the double seamed upper end. Preferably, the lip element snaps 42 onto the upper end 32 in a semi-permanent fashion. Additional sealing elements or adhesive may be provided, as needed.

As will be clear to those of skill in the art, the insulated outer shell may be formed in a variety of ways. For example, the outer shell may have an inner wall that defines the inner surface and a layer of insulating material that is applied to this inner wall and defines the outer surface of the outer shell. In the illustrated version, the outer shell 20 has a first wall 48 and a second wall 50 that each have closed lower ends and open upper ends. The first and second walls are joined at their open upper ends to form the outer shell. A chamber 52 is defined between the walls. The chamber 52 may be filled with air or other gas, acting as an insulating material. However, preferably, the chamber is filled with an insulating material such as insulating foam, or is evacuated so as to form a vacuum insulated outer shell. Such a vacuum is typically a partial vacuum.

In some versions, the inner and outer walls are both metal. In these versions, the inner vessel is also metal. In versions with an outer shell with two metal walls, the two walls may be joined at their upper ends by welding or the double seaming process may serve to join the upper ends. In further versions, the inner vessel 12 is metal but the walls 48 and 50 of the outer shell 20 are plastic. The plastic walls may be joined at their upper edges by being molded together, glued or melted together, or by other processes. The upper ends of the metal inner vessel and plastic outer shell may be double seamed as illustrated, thereby forming a seal. This process may also interconnect the upper ends of the walls 48 and 50. Additional sealant, adhesive, or melting of the plastic may be used to improve the seal. In an alternative, one of the walls 48 or 50 is plastic while the other is not. In some versions, plastic walls are coated so as to allow them to hold a vacuum and/or resist interaction with the phase change material.

As will be clear to those of skill in the art, the phase change material and insulating material may be provided in a number of ways. In one approach, where the outer shell is vacuum insulated, a port is provided in the outer wall 50. After the walls of the outer shell are interconnected, the cavity 52 is at least partially evacuated and the port is sealed. In a version where an insulating material is provided between the walls 48 and 50, the insulating material may be added prior to inserting the inner wall 48 into the outer wall 50. The same may be done with the phase change material. It may be added to the inside of the insulated outer shell prior to inserting the inner vessel into the outer shell 20. One example of an assembly method for a liquid receptacle in accordance with the present invention is to first form the insulated outer shell having an open upper end with an outwardly extending flange. An inner vessel is also formed with an open upper end with an outwardly extending flange. This inner vessel is formed of metal. A phase change material is added to the inside of the insulated outer shell and then the inner vessel is inserted down into the outer shell causing at least some of the phase change material to be displaced up into the chamber between the side walls. The phase change material and the outer shell and inner vessel are warmed to maintain the phase change material in a liquid state during the process. A chuck is then inserted into the inside of the inner vessel and a seam roller rolls the flange on the inner vessel around the flange of the outer shell to form a double rolled connection. This connection is compressed or crimped, which is defined as compressing the metal flange of the inner vessel sufficiently to produce the desired mechanical interconnection. This manner of connection and sealing is commonly described in the industry which stores food in metal cans as a "hermetic double seam." Other approaches to interconnecting the inner vessel and outer shell may also be used.

The inner vessel 12 is preferably formed of a material with good heat transfer properties. It is desirable to transfer heat from liquid contained in the inner vessel 12 into the phase change material 30 rapidly so as to rapidly lower the temperature of the liquid to the desired range. One preferred material is aluminum. The aluminum may be coated or anodized on its inner surface to improve its appearance, durability and/or food contact properties. Other materials may be used. For example, other metals, including stainless steel, may be used for the inner vessel. While metals such as stainless steel have a lower thermal conductivity than aluminum, the thermal conductivity is sufficient for some applications. According to a further embodiment, the inner vessel may be at least partially formed of a thermally conductive plastic, such as thermally conductive HDPE. While this plastic also has a thermal conductivity lower than aluminum, and also lower than most metals, the thermal conductivity may be sufficient for some applications.

Figure 4:
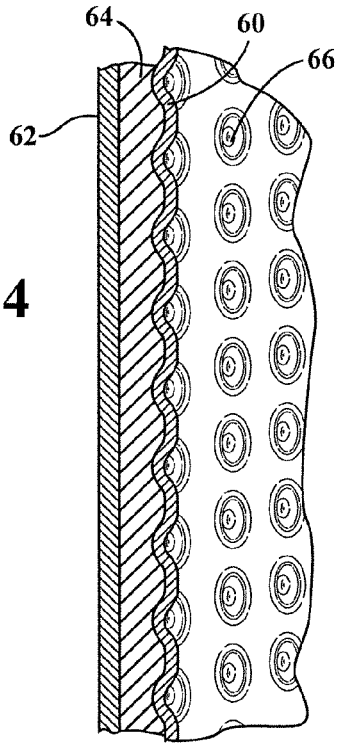
FIG. 4 is a cross-sectional view of a portion of a liquid receptacle showing a dimpled inner vessel.

As known to those of skill in the art, it is desirable to use a material for the inner vessel that quickly conducts thermal energy from the liquid to the phase change material. The present invention further provides approaches for improving the transfer of energy from the liquid to the phase change material, other than the use of more thermally conductive materials. Referring to FIG. 4, a portion of a liquid receptacle in accordance with the present invention is shown. A wall of an inner vessel is shown at 60. Another wall is shown at 62, spaced from the inner wall 60. A chamber 64 is defined between the two walls. This drawing is generic to any of the embodiments of the present invention, as well as to other designs. The wall 62 may be considered to be the inner wall of an insulated outer shell. As shown, the inner wall 60 has a plurality of indentations 66 defined therein. These indentations distort the wall 60 thereby increasing the surface area both on the inner surface and outer surface. The wall 60 may be said to have indentations in the inner surface and corresponding protrusions in the outer surface. In the illustrated embodiment, the wall thickness is substantially uniform. Alternatively, the wall thickness may vary somewhat, due to the process of adding the indentations. The indentations may take any of a variety of forms. The configuration may also be reversed, with the indentations being formed in the outer surface and corresponding protrusions on the inner surface, or protrusions and indentations may be mixed on each surface.

Figure 5:
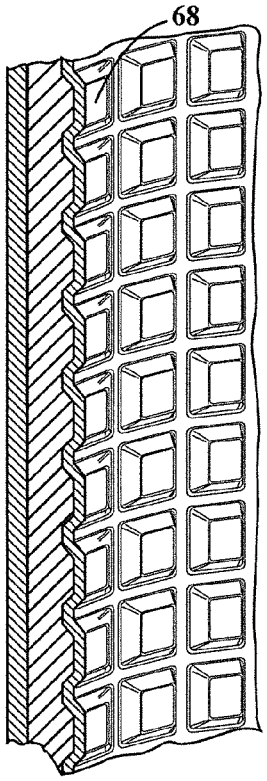
FIG. 5 is a cross-sectional view similar to FIG. 4 showing a waffle-like pattern of indentations.

In FIG. 4, the indentations take the form of a plurality of dimples uniformly distributed on the wall 60. Alternatively, the dimples may be distributed differently than shown, may have different shapes than shown, or may be spaced apart differently than shown. In one example, the surface may have more of the appearance of the surface of a golf ball. FIG. 5 illustrates an alternative version wherein the indentations extend from the outer surface to the inner surface in a waffle-like grid with each indentation being generally square. This foul's protrusions 68 on the inner surface. Further alternatives are indentations that are in the form of lines or grooves such as forming a grid. As will be clear to those of skill in the art, these various approaches substantially increase the surface area of both the inner and outer surfaces.

One challenge with phase change materials is that as heat is transferred through the inner wall into the phase change material, the phase change material closest to the wall melts or changes phase. Phase change materials often have poor thermal conductivity, and further the thermal conductivity is often lower in a phase change material in a liquid state than it is in that same phase change material in a solid state. Phase change material farther from the wall may not melt and the rate of heat transfer into the chamber containing the phase change material may drop off. Put another way, it is often a challenge to transfer the heat into the phase change material that is farther from the wall.

Figure 6:
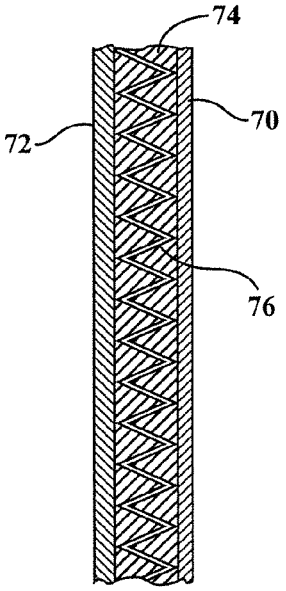
FIG. 6 is a cross-sectional view of a portion of a liquid receptacle in accordance with the present invention having a folded fin heat sink in the phase change chamber.

According to an additional aspect of the present invention, approaches are provided for improving the transfer of heat across the chamber by augmenting thermal conductivity and/or heat flow properties through design and materials to enhance thermal performance. Referring to FIG. 6, an inner wall is shown at 70, an outer wall is shown at 72, and a chamber 74 is defined therebetween. The chamber 74 is filled with a phase change material. Additionally, a metal heat transfer element is disposed in the chamber 74. The metal heat transfer element may take a variety of forms. In FIG. 6, a folded fin heat sink 76 is provided. It is a very thin sheet of highly conductive metal that is folded into a zigzag pattern and is positioned so as to extend between the walls 70 and 72. When used with a thermal receptacle as discussed herein, one approach would be to insert the heat sink 76 between the concentric walls of the inner vessel and outer shell such that the zigzag pattern would be seen in a horizontal cross section. FIG. 6 merely illustrates a pair of parallel walls, whereas in use the walls would likely be curved.

Figure 7:
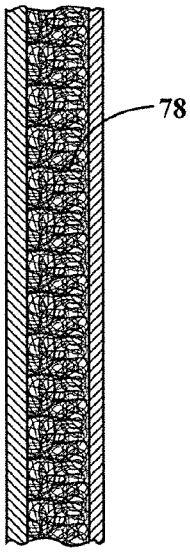
FIG. 7 is a cross-sectional view similar to FIG. 6 showing a body of aluminum wool disposed in the phase change chamber.
Figure 8:
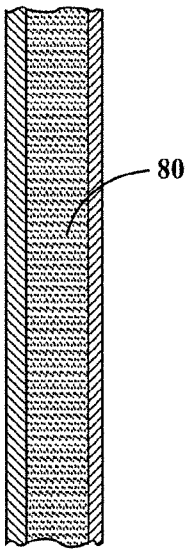
FIG. 8 is a cross-sectional view similar to FIGS. 6 and 7 showing a metal mesh or a metal or graphite powder disposed in the phase change chamber.

FIG. 7 illustrates an alternative version in which the metal heat transfer element is a body of aluminum wool 78. Aluminum wool consists of a large number of very thin strands of aluminum bunched together similar to steel wool. FIG. 8 illustrates yet another approach in which a metal mesh 80 is provided between the walls. Alternatively, FIG. 8 may be considered to illustrate a plurality of metal or graphite particles dispersed in the phase change material. Each of these approaches may improve the transfer of heat from the phase change material close to the inner wall to the phase change material that is farther from the inner wall.

Figure 9:
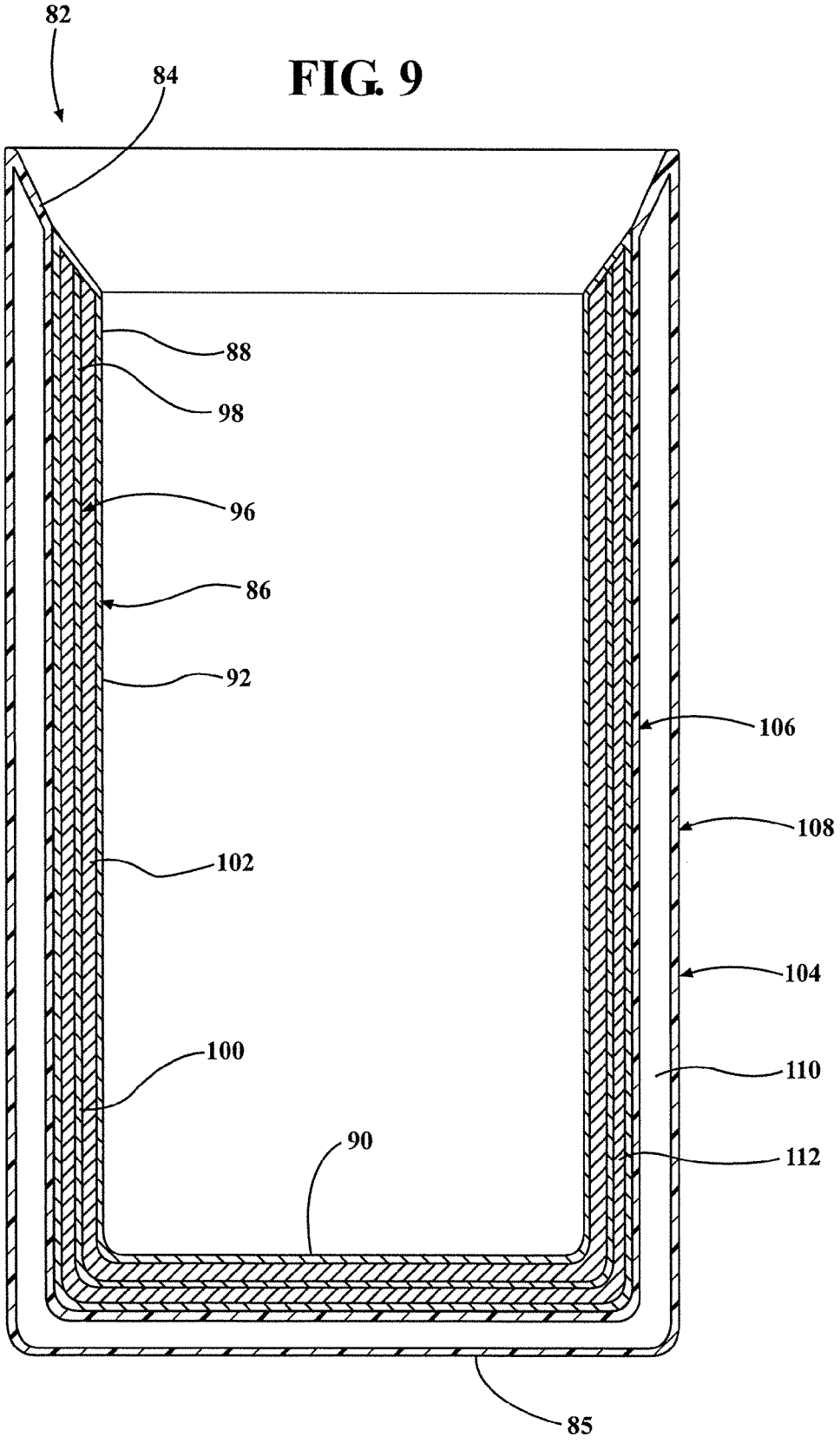
FIG. 9 is a cross-sectional view of a further embodiment of the present invention having at least two chambers.

Referring now to FIG. 9, a further embodiment of the present invention will be discussed. FIG. 9 illustrates a liquid receptacle 82 with a drinking lip 84 at the uppermost end and a base 85 at the lowermost end. The receptacle 82 includes an inner vessel 86 with an open upper end 88 and a closed lower end 90. A side wall 92 extends between the lower end 90 and upper end 88. A first intermediate wall 96 has an upper end 98 and a lower end 100. The first intermediate wall 96 surrounds the inner vessel 86 and is at least partially spaced therefrom so as to define a first chamber 102 therebetween. An insulated outer shell 104 is formed by a second intermediate wall 106 and an outer wall 108. The outer wall 108 is at least partially spaced from the second intermediate wall 106 so as to define an insulation chamber 110 therebetween. The second intermediate wall 106 surrounds the first intermediate wall 96 and is spaced therefrom so as to define a second chamber 112 therebetween.

In the illustrated embodiment, the second intermediate wall is shown as a two layer wall, such as two layers of metal. This represents a version in which an inner assembly is press fit into an outer assembly to form the receptacle 82. Alternatively, the second intermediate wall is a single layer.

In the illustrated embodiment, the inner vessel 86, first intermediate wall 96, second intermediate wall 106, and outer wall 108 all have a similar shape and are nested within each other so as to form a four-wall vessel. In the illustrated embodiment, the chambers between the walls extend between the sides as well as across the bottom of the vessel. The upper ends of the inner vessel and the walls are interconnected at the upper lip 84. In the illustrated embodiment, the first chamber 102 has a first phase change material disposed therein, while the second chamber 112 has a second phase change material disposed therein. The phase change materials may be the same or may be different materials and/or have different phase change temperatures. In one example, the phase change temperature of the second phase change material is slightly higher than the phase change temperature of the first phase change material. The insulation chamber 110 may have a vacuum or an insulating material disposed therein. In the illustrated embodiment, this chamber is shown as empty, which may correspond to a vacuum or to air. In alternative embodiments, the outer shell may be formed in other ways, not having two separate walls. In this case, the inner surface of the insulated outer shell forms the outer wall of the second chamber 112. In further alternatives, the second chamber may not have a second phase change material therein. In yet further versions, additional walls are provided so as to provide additional chambers, such as a five or six wall receptacle with four or five chambers.

In versions having two phase change materials, the first phase change material in the first chamber 102 may very quickly change phases, or melt, as heat is transferred through the wall of the inner vessel 92 into the phase change material. Heat may then be transferred into the second chamber 112 causing the second phase change material to begin to melt. However, by choosing the phase change temperatures of the phase change materials and the construction materials of the various walls of the device, the heat flow can preferentially be directed to flow back towards the liquid rather than outwardly to the insulated outer shell. As compared to a receptacle having a single phase change material in a single chamber, the illustrated version may have a lower quantity of phase change material in the first chamber than the total used in a single phase change material version. As such, the entirety of the phase change material in the first chamber melts more quickly, and then further heat transfer may occur to the second chamber.

In a further version, having multiple chambers, phase change material may be provided in a first chamber and a third chamber with a second chamber being disposed between the first and third chamber. A heat transfer material, such as water, oil or other liquids, may then be provided in the second chamber.

As will be clear to those of skill in the art, a receptacle with four or more walls may be formed in various ways. In one approach, the upper portion of the vessel is molded out of plastic with concentric walls. A bottom cap is then attached, such as by spin welding, to define the bottoms of each wall. The different chambers then may be filled through ports. The embodiment illustrated in FIG. 9 may be referred to as a four-wall receptacle or, where the insulated outer shell is not formed with two walls, it may be referred to as a two chamber receptacle. Other numbers of walls may be formed. In another approach, the receptacle is formed using metal injection molding, allowing the creation of accurate parts.

Figure 10:
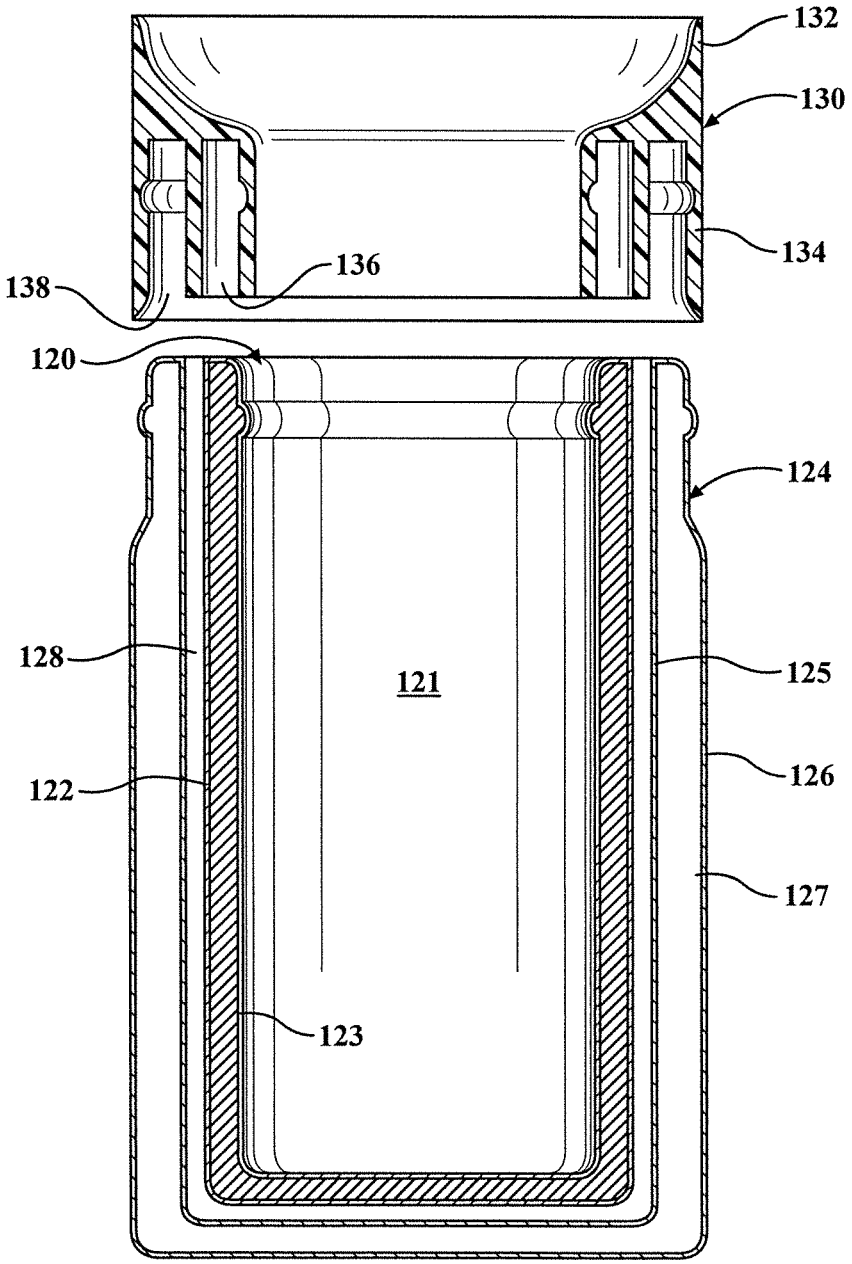
FIG. 10 is a cross-sectional exploded view of a further embodiment of the present invention having an inner two wall cup and an outer two wall cup interconnected by a lip element.
Figure 11:
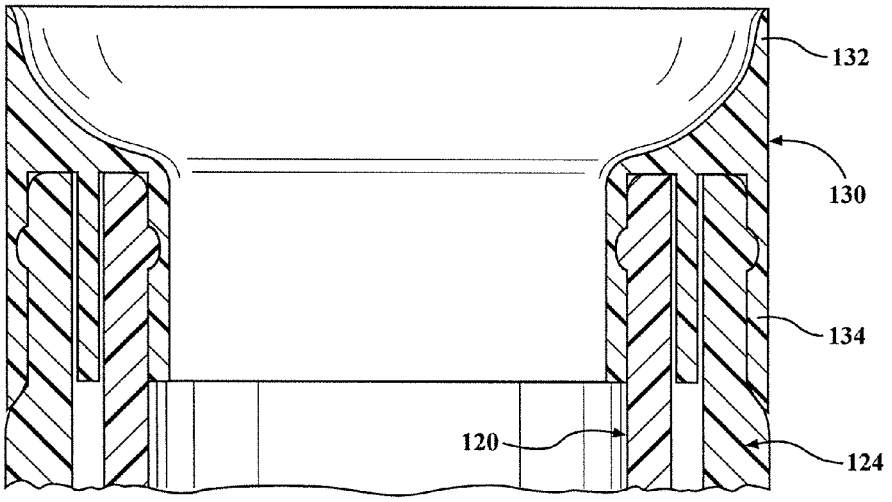
FIG. 11 is a detailed view of the upper end of the liquid receptacle of FIG. 10 after the inner and outer cups are received by the lip element.

Referring now to FIGS. 10 and 11, a different approach to forming a two-chamber or four-wall receptacle will be discussed. In this version, an inner two wall cup 120 is received inside of an outer two wall cup 124. Each of these two wall cups may be formed in a variety of ways. In one approach, an inner and outer wall are interconnected in the same way as discussed for FIGS. 1-3, wherein an upper edge of each wall is interconnected by double seaming. The two wall cup may also be formed in any of the ways currently used to form vacuum insulated vessels. The two wall cup may also be formed by molding, including plastic or metal injection molding.

In the illustrated embodiment, the inner two wall cup 120 may be said to have an inner vessel 121 that is surrounded by a first intermediate wall 122. The inner vessel and intermediate wall 122 are interconnected at their upper ends and are spaced apart so as to define a chamber 123 defined therebetween. This is the first chamber, corresponding to the first chamber in FIG. 9. A second intermediate wall 125 and an outer wall 126 form the outer two wall cup 124. The walls are spaced apart so as to define an insulation chamber 127, which is filled with an insulating material or is evacuated. The second intermediate wall 125 is spaced from the first intermediate wall 122 when the inner two wall cup 120 is received in the outer two wall cup 124. This defines the second chamber 128. The inner two wall cup 120 and outer two wall cup 124 may be interconnected by double seaming the upper ends. However, in the illustrated embodiment, a lip element 130 interconnects the two cups. The lip element 130 has an upper part 132 that defines a drinking lip and a lower part 134 that receives the upper ends of the inner two wall cup and the outer two wall cup. The lower part 134 has a pair of concentric grooves 136 and 138 and the inner and outer cups preferably snap into these grooves. Sealing elements or materials may be provided for improving the seal. Alternatively, the inner and outer cups may thread into the lip element 130. FIG. 10 shows the inner and outer cup before being assembled into the lip element 130 and FIG. 11 shows the upper portion after the pieces are assembled.

This approach may allow inner two wall cups filled with different phase change materials to be interconnected with outer two wall cups to form receptacles with different performance characteristics. In one approach, a plurality of inner two wall cups are produced with different phase change materials. Outer two wall cups are also produced with phase change materials in the chamber. The inner two wall cup can be received in the outer two wall cup, with a heat transfer material in the chamber 128 therebetween, to transfer heat from the inner chamber to the outermost chamber. The heat transfer material may be a liquid such as water or oil. The outer two wall cup may have an additional layer of insulation thereon, or may have another chamber and be a three wall cup. In one option, the outer two wall cup has a phase change material in the chamber between its walls, and the phase change materials are chosen such that heat preferentially flows back to the inner vessel.

An approach similar to that shown in FIGS. 10 and 11 may be used to provide more than four walls. For example, a six wall receptacle may be formed by nesting three two wall cups and interconnecting them using a lip element.

Figure 12:
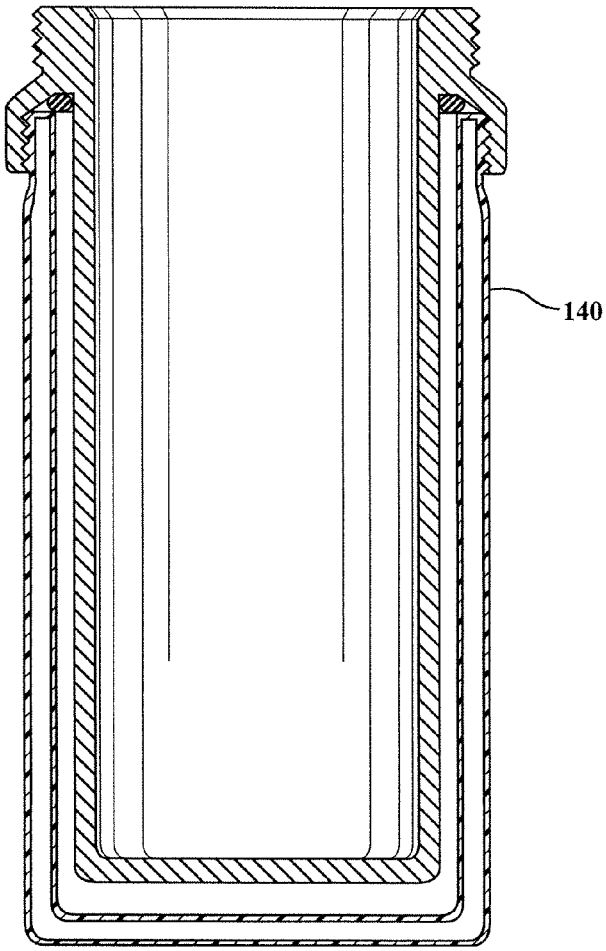
FIG. 12 is a cross-sectional view of a further alternative wherein an inner two wall cup and an outer two wall cup threadingly interconnect.
Figure 13:
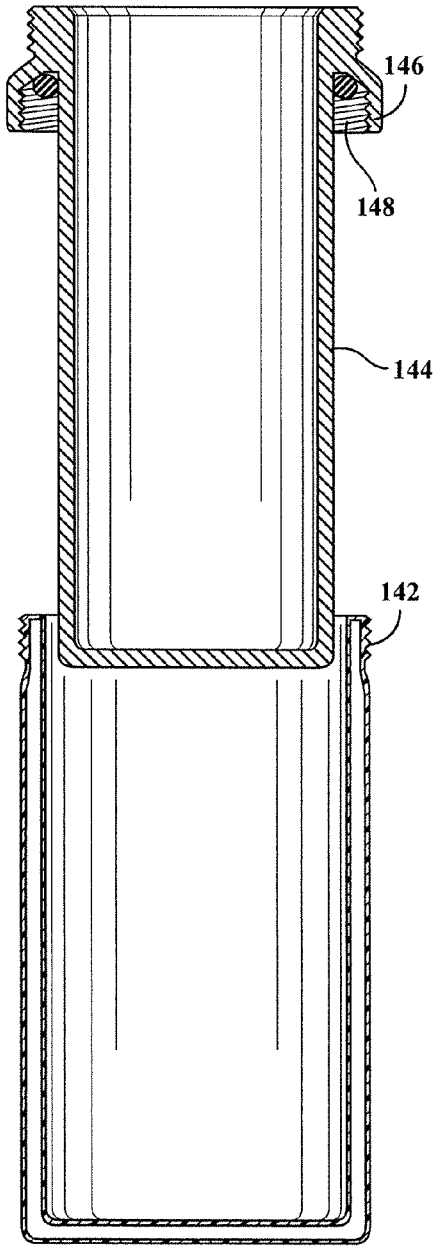
FIG. 13 is a view of the components of FIG. 12 with the inner cup and outer cup separated.

Referring now to FIGS. 12 and 13, an alternative approach is illustrated. In this approach, an outer two wall cup 140 has threads 142 defined on the outer surface of its upper end. An inner two wall cup 144 has a receiving portion 146 near its upper edge with threads 148 on the inside of the receiving area. These threads 148 cooperate with the threads 142 so as to interconnect the inner cup 144 with the outer cup 140. The inner cup 144 is also shown as having threads on an outer surface near its upper edge for threadingly connecting a lid or a lip element. A seal may be provided above the threads 148 in the receiving portion 146. This approach could allow different two wall cups to be interconnected to provide different performance characteristics. As one example, the inner two wall cup could have one phase change material therein and the outer two wall cup could have another. A heat transfer liquid could fill the chamber between the two cups.

Figure 15:
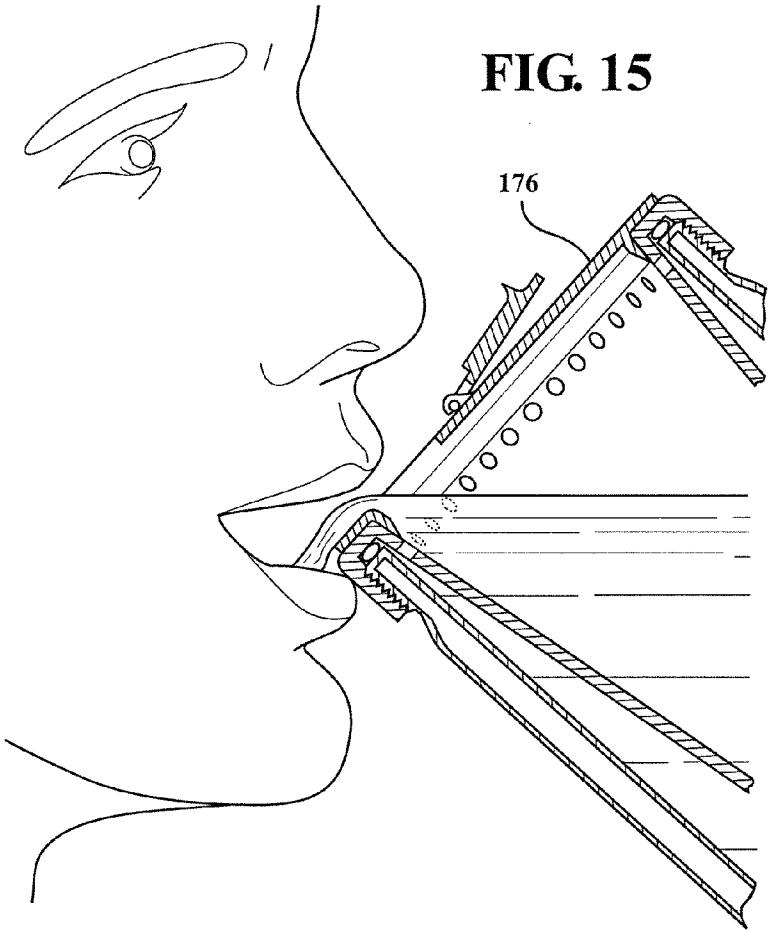
FIG. 15 is a view of the assembly of FIG. 14 tilted for drinking.
Figure 14:
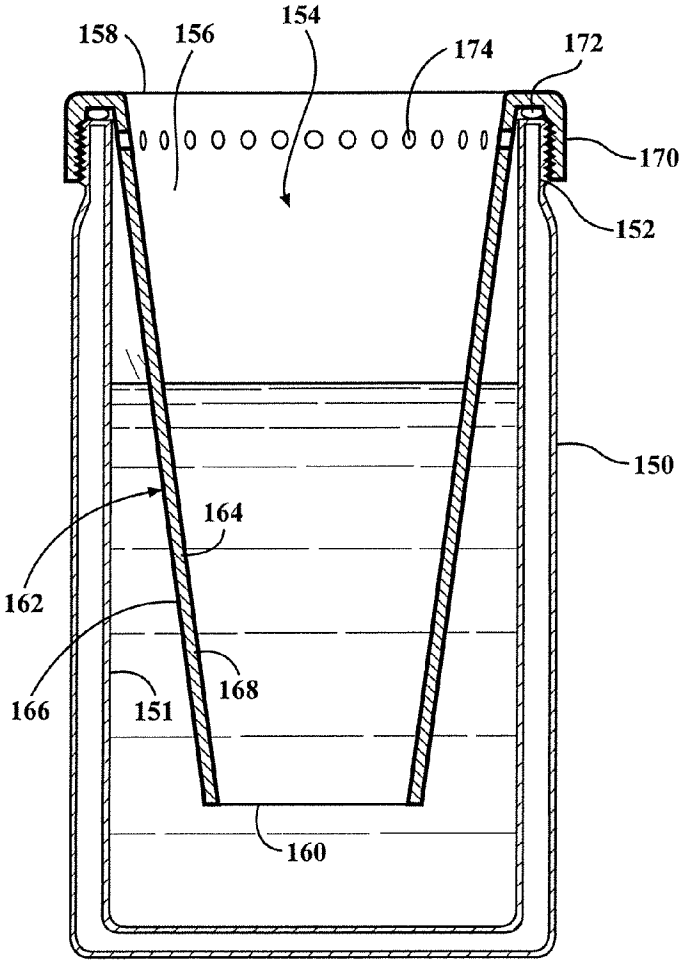
FIG. 14 is a cross-sectional view of an embodiment of the present invention providing an insert for an insulated cup.

Referring now to FIGS. 14 and 15, the present invention also provides an apparatus for providing the benefits of phase change material to an insulated cup such as the many currently available insulated mugs. Such an insulated cup is shown at 150 in FIG. 14. The illustrated version is a double wall vacuum insulated cup with a threaded upper end 152. This is merely exemplary of the wide variety of insulated cups available, some of which have upper drinking lips and others have detachable lips or lids. The illustrated cup 50 is of the type that would have a separate lid or lip element that forms the drinking lip. The present invention provides a phase change apparatus 154 designed to interconnect with the insulated cup 150. The phase change apparatus includes a generally tubular housing 156 with an open upper end 158 and an open lower end 160. In the illustrated embodiment, the generally tubular housing 156 is tapered such that the open lower end 160 is substantially smaller than the open upper end 158. A side wall 162 extends between the upper end 158 and lower end 160 and has an inner surface 164 facing inwardly and an opposed outer surface 166 facing outwardly. A chamber 168 is defined between the inner surface 164 and outer surface 166. A phase change material is disposed in this chamber 168 for regeneratively absorbing thermal energy from a liquid in the insulated cup 150 and then releasing the thermal energy back to the liquid to maintain the temperature of the liquid.

As shown in this embodiment, the outer surface 166 of the side wall 162 is spaced inwardly from the inner surface 151 of the insulated cup 150 such that liquid fills the space between the surfaces as well as inside the tubular housing. This provides a large surface area for transferring heat between the liquid and the phase change material. The upper end 158 of the tubular housing is configured to engage the upper end of the insulated cup, as shown. In this embodiment, the upper end 158 includes a receiver 170 that threads onto the threads of the upper end 152 of the cup 150. A sealing element 172 is provided for sealing between the generally tubular housing and the cup 150. A plurality of passages 174 are defined between the inner surface 164 and outer surface 166 of the generally tubular housing near the upper end of the housing. As best shown in FIG. 15, these openings allow liquid disposed between the inner surface 151 of the insulated cup and the outer surface 166 of the tubular housing to flow therethrough and to be consumed. FIG. 15 also illustrates a snap-on lid 176 that may form part of the drinking lip of the cup. The tubular housing is preferably formed of a material with good thermal conductivity. However, the upper end may be made of or covered with a less thermally conductive material, such as plastic.

Figure 16:
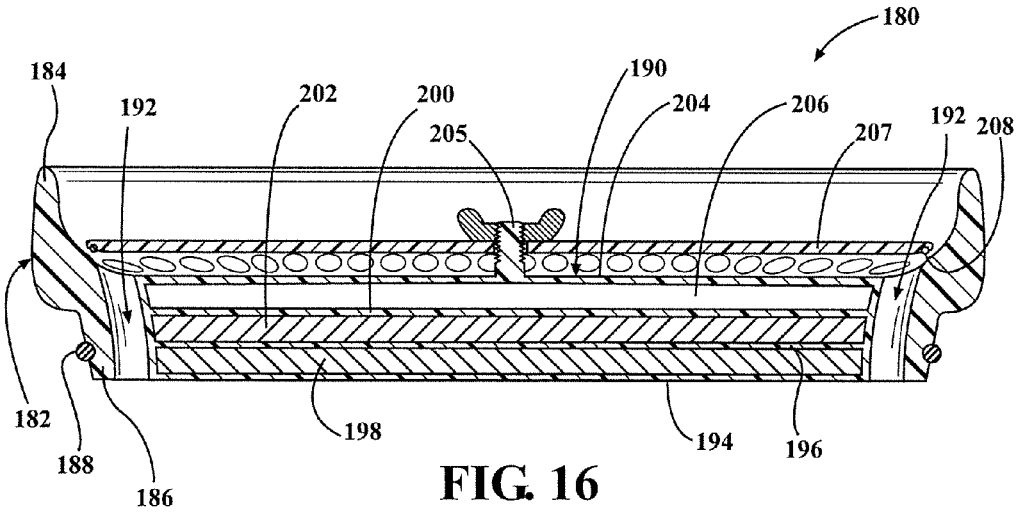
FIG. 16 is a cross sectional view of a beverage lid with at least one chamber defined therein.

FIG. 16 illustrates a drinking lid 180 that may form an aspect of the present invention, and may be used with other aspects described herein. The lid has a perimeter 182 with a drinking lip 184 and a lower portion 186. The lower portion 186 may be configured to be received in or on the upper end of a cup or mug. In the illustrated embodiment, the lower portion has an outer surface designed to fit into the upper end of a mug or cup, with a sealing element 188 for providing a good seal. Any configuration may be used, including threaded, snap-on and press-fit. The lid 180 has a central portion 190 that is spaced inwardly from the perimeter 182 so as to define a plurality of drinking passages adjacent the perimeter. The central portion 190 has a bottom wall that faces the inside of the mug or cup. A first intermediate wall 196 is spaced upwardly from the bottom wall so as to define a first chamber 198 therebetween. In this embodiment, the chamber 198 is filled with a first phase change material. In the illustrated embodiment, the central portion 190 further has a second intermediate wall 200 spaced upwardly from the first intermediate wall 196 so as to define a second chamber 202 therebetween. A second phase change material is disposed in the second chamber 202. A top wall 204 is spaced above the second intermediate wall 200 so as to define an insulation chamber 206 therebetween. The insulation chamber may be evacuated or filled with an insulating material. The lid 180 helps to maintain the temperature of a beverage in the cup but may also help to modulate the temperature of liquid that flows through the passages 192. Alternative versions may include only a single chamber for phase change material, with or without insulation.

FIG. 20 also shows an optional sealing cap 207 for the lid 190. In this version, a center post 205 extends up from the top wall 204. The post 205 may be threaded. The cap 207 fits onto this post and extends outwardly to a perimeter edge with a perimeter seal 208. As shown, the perimeter and seal 208 is located outboard of the passages 192. As such, if the cap 207 is tightened against the lid 190, the seal 208 seals the top of the lid. Tightening of the cap may be accomplished in several ways. A thumb screw is illustrated, which may form part of the cap or be separate. The entire cap may rotate to tighten. Other approaches are also possible. The seal 208 may take different forms. For example, a wider seal may be provided and positioned so as to seal the openings 192 themselves, rather than the entire area.

A variety of phase change materials may be used with the present invention. In some embodiments, a preferred phase change material is palmitic acid. The phase change temperature of the phase change material may be selected to provide a desired drinking temperature. This temperature may be different for different applications, such as providing a higher temperature phase change material for users that like to drink beverages very hot and a lower temperature phase change material for those that prefer beverages at a lower temperature. In embodiments using two phase change materials, the phase change material in the inner chamber may be stearic acid or palmitic acid. Preferably, any phase change materials selected are non-toxic, food-grade materials that are also not corrosive or reactive to the metals or materials being used for containment of such phase change materials. In some versions, the phase change material has a phase change temperature in the range of 61 to 68 degrees Celsius.

As will be clear to those of skill in the art, the herein described embodiments of the present invention may be altered in various ways without departing from the scope or teaching of the present invention. It is the following claims, including all equivalents, which define the scope of the invention.

I claim:

1. A phase change apparatus for rapidly lowering the temperature of a liquid contained in an insulated cup of the type having an open upper end, a closed lower end and a side wall extending therebetween, the apparatus comprising:

a generally tubular housing having an open upper end and an open lower end with a side wall extending therebetween, the sidewall having an inner surface and an outer surface, the sidewall further having a chamber defined therein;

a phase change material disposed within the chamber for regeneratively absorbing thermal energy from a liquid and then releasing the thermal energy to the liquid to maintain the temperature of the liquid;

the upper end of the generally tubular housing being configured to engage an upper end of an insulated cup such that the generally tubular housing extends down into the insulated cup inside the side walls of the insulated cup.

2. The phase change apparatus in accordance with claim 1, wherein:

the generally tubular housing is tapered such that the upper end has a width greater than a width of the lower end.

3. The phase change apparatus in accordance with claim 1, wherein:

the upper end of the generally tubular housing has a lip element, the lip element has an upper part defining a drinking lip and a lower part configured to receive an upper end of an insulated cup.

4. In combination, an insulated cup and a phase change apparatus for use with the insulated cup, the combination comprising:

an insulated cup having an open upper end, a closed lower end and a side wall extending therebetween, the side wall having an inner surface;

a phase change apparatus for rapidly lowering the temperature of a liquid contained in the insulated cup, the phase change apparatus comprising;

a generally tubular housing having an open upper end and an open lower end with a side wall extending therebetween, the sidewall having an inner surface and an outer surface, the sidewall further having a chamber defined therein;

a phase change material disposed within the chamber for regeneratively absorbing thermal energy from a liquid and then releasing the thermal energy to the liquid to maintain the temperature of the liquid;

the upper end of the generally tubular housing engaging the open upper end of the insulated cup such that the generally tubular housing extends down into the insulated cup inside the side walls of the insulated cup, the outer surface of the sidewall of the generally tubular housing being spaced from the inner surface of the insulated cup such that a liquid filling the insulated cup is disposed between the outer surface of the sidewall of the generally tubular housing and the inner surface of the insulated cup and is disposed within the generally tubular housing.

5. The combination of claim 4, wherein the insulated cup comprises a double wall vacuum insulated cup.

6. The combination of claim 4, wherein the insulated cup has a threaded upper end and the generally tubular housing has corresponding threads at the upper end for engaging with the upper end of the insulated cup.

7. The combination of claim 4, wherein the generally tubular housing is tapered such that the upper end has a width greater than a width of the lower end.

8. The combination of claim 4, wherein the upper end of the generally tubular housing has a lip element, the lip element has an upper part defining a drinking lip and a lower part receiving the upper end of the insulated cup.

9. The combination of claim 4, wherein the phase change material comprises stearic acid or palmitic acid.

10. The combination of claim 4, wherein the generally tubular housing of the phase change appratus further comprises a plurality of passages defined between the inner surface and outer surface of the side wall of the generally tubular housing, the passages being defined near the upper end of the generally tubular housing;

wherein the plurality of passages defined in the side wall of the generally tubular housing of the phase change apparatus allow a liquid disposed between the outer surface of the generally tubular housing and the side wall of the insulated cup to flow through some of the passages when the insulated cup is tilted for drinking.

11. The combination of claim 10, wherein the upper end of the generally tubular housing is made a material with less thermal conductivity than a remainder of the generally tubular housing.

12. The combination of claim 4, wherein the upper end of the generally tubular housing is made a material with less thermal conductivity than a remainder of the generally tubular housing.

13. The combination of claim 4, further comprising a lid that engages the upper end of the generally tubular housing.

14. The combination of claim 13, wherein the lid forms part of a drinking lip of the combination.

* * * * *